US008116655B2

(12) United States Patent
Goebel et al.

(10) Patent No.: US 8,116,655 B2
(45) Date of Patent: Feb. 14, 2012

(54) CHARGE ROLLER CLEANING MEMBER FOR USE IN MEDIA PROCESSING DEVICE

(75) Inventors: Benjamin John Goebel, Lexington, KY (US); Christian Blair Miller, Delaware, OH (US)

(73) Assignee: Lexmark International, Inc., Lexington, KY (US)

( * ) Notice: Subject to any disclaimer, the term of this patent is extended or adjusted under 35 U.S.C. 154(b) by 717 days.

(21) Appl. No.: 12/252,419

(22) Filed: Oct. 16, 2008

(65) Prior Publication Data

US 2010/0098453 A1 Apr. 22, 2010

(51) Int. Cl.
*G03G 15/02* (2006.01)

(52) U.S. Cl. ..... 399/100

(58) Field of Classification Search ..... 399/100, 399/99, 115, 123, 347
See application file for complete search history.

(56) References Cited

U.S. PATENT DOCUMENTS

| | | | | |
|---|---|---|---|---|
| 4,750,018 | A * | 6/1988 | Gooray et al. | 399/390 |
| 5,557,373 | A * | 9/1996 | Miyashita et al. | 399/9 |
| 5,629,755 | A * | 5/1997 | Ohtsuka | 399/176 |
| 5,697,020 | A * | 12/1997 | Sato et al. | 399/100 |
| 5,799,229 | A * | 8/1998 | Yokoyama et al. | 399/100 |
| 7,356,278 | B2 | 4/2008 | Piotrowski | |
| 2002/0076234 | A1 * | 6/2002 | Kitazawa et al. | 399/100 |
| 2006/0222399 | A1 * | 10/2006 | Thompson | 399/100 |

* cited by examiner

*Primary Examiner* — David Gray
*Assistant Examiner* — Rodney Bonnette
(74) *Attorney, Agent, or Firm* — John Victor Pezdek

(57) ABSTRACT

A segmented cleaning member for removing particulate from a charge roller of a media processing device. The cleaning member in one embodiment includes a substrate and an open-cell foam cleaning pad disposed onto the substrate. The cleaning pad is segmented by a plurality of cuts into a plurality of longitudinal sections capable of contacting the charge roller for removing the particulate from the charge roller. Various cut patterns made be used to form the sections. The cleaning member can be used in media processing device and cartridge therefor for removing the particulate from the charge roller.

22 Claims, 4 Drawing Sheets

CHARGE ROLLER CLEANING MEMBER FOR USE IN MEDIA PROCESSING DEVICE

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure generally relates to a media processing device, and more specifically, to a cleaning member employed in a media processing device.

2. Description of the Related Art

A media processing device, such as an electrophotographic image forming device, is typically employed to generate a printed image on a media sheet. Suitable examples of the electrophotographic image forming device include laser printer, copying machine, multifunctional peripheral and the like. Suitable examples of the media sheet include, but are not limited to, paper, transparencies, textiles substrates, non-woven substrates, canvas substrates, and cellulose substrates.

The electrophotographic image forming device includes a photoconductor drum (hereinafter referred to as a "PC drum") composed of photoconductive materials. The PC drum is capable of photo-generating a charge on a surface thereof when contacted with a stream of photons. Further, the electrophotographic image forming device includes a charge roller composed of conductive materials for charging the PC drum to a predetermined voltage. Usually, such a predetermined voltage is required for the photo-generation of the charge on the surface of the PC drum when the PC drum is contacted with the stream of photons. Furthermore, the electrophotographic image forming device includes a developer roller for transferring a toner medium including toner particles onto the PC drum.

Usually, the stream of photons is provided by an optical assembly operatively coupled to the PC drum. The optical assembly includes a laser unit, and a plurality of mirrors and a plurality of lenses. The laser unit generates a modulated stream of photons, and subsequently, the one or more mirrors and one or more lenses are used to move the photons across the surface of the PC drum to create a temporary image to be printed (hereinafter referred as an "electrostatic latent image").

After the generation of the electrostatic latent image, the developer roller provides the toner medium to the PC drum. The toner particles of the toner medium affix to the electrostatic latent image (due to electrostatic interactions) thereby generating a toned electrostatic latent image. The toned electrostatic latent image is then transferred and fixed onto a media sheet to generate an image on the media sheet.

During the image forming process, a particulate build-up may occur on the PC drum, and more specifically, over a peripheral surface of the PC drum. Usually, such particulate include non-transferred toner particles, paper dust, and toner additives. Further, the particulate build-up may gradually increase over a period of time resulting in deterioration of quality of the image formed by the PC drum.

In order to circumvent the aforementioned drawback, a cleaning blade may be configured to contact the PC drum for cleaning the PC drum. Usually, the cleaning blade employs mechanical means to remove the particulate from the peripheral surface of the PC drum. However, some cleaning blades may employ electrostatic means to remove the particulate from the peripheral surface of the PC drum.

Despite the use of the cleaning blade, some of the particulate may get carried away and go onto the charge roller. Consequently, such particulate may adhere to the charge roller thereby coating a peripheral surface of the charge roller. Such a coating of the peripheral surface of the charge roller may reduce roughness and electrical resistivity of the peripheral surface of the charge roller leading to a reduction in charging ability of the charge roller. The reduction in the charging ability of the charge roller causes defects in the image developed by the electrophotographic image forming device. Examples of such defects may include, but are not limited to, background fouling, darkness density unevenness, light or dark vertical streaks, and blurred print. As a result, the overall quality of the image developed by the electrophotographic image forming device degrades.

Accordingly, a cleaning member is usually configured to contact the peripheral surface of the charge roller for removing the particulate from the charge roller. The cleaning member may be in form of a roller or a pad. Suitable examples of the cleaning member in the form of the roller may include, but are not limited to, a rubber foam type roller, and a fiber brush type roller. Similarly, suitable examples of the cleaning member in the form of the pad, may include, but are not limited to, a rubber foam type pad, and a fiber brush type pad.

An example of a conventional cleaning member employed for removing particulate from the charge roller of an electrophotographic image forming device includes a flexible and an elongated substrate having a pad composed of open-cell foam. The open-cell foam has a flat surface that engages with the charge roller for removing the particulate therefrom. In addition, the conventional cleaning member is positioned between the charge roller and a surface of the electrophotographic image forming device, at a particular angle, to apply a specific cleaning pressure onto the charge roller.

However, the conventional cleaning member provides an insufficient cleaning pressure onto the charge roller. Further, it has been observed that the application of the specific cleaning pressure results in either a permanent or a semi-permanent compression of the open-cell foam of the conventional cleaning member. Such a permanent or semi-permanent compression of the open-cell foam may affect cleaning ability of the conventional cleaning member. Furthermore, the conventional cleaning member provides a large magnitude of frictional drag during cleaning the charge roller, thereby leading to frequent stalling of the charge roller.

In addition, the conventional cleaning member does not provide a wide tolerance for thickness of the open-cell foam of the cleaning member due to the inability to precisely cut the open-cell foam. Moreover, the open-cell foam of the conventional cleaning member provides insufficient volume for retaining the particulate removed from the peripheral surface of the charge roller.

Accordingly, there is a need to develop a cleaning member for use in an electrophotographic image forming device that is capable of providing sufficient cleaning pressure for effectively cleaning a charge roller of the electrophotographic image forming device without causing any frequent stalling of the charge roller. Further, the cleaning member should be designed in a specific manner in order to prevent any likelihood of physical damage thereof during a cleaning operation. Furthermore, the cleaning member should efficaciously retaining particulate removed from the charge roller for proper cleaning thereof and thus help increase the effective lifetime of the electrophotographic image forming device.

SUMMARY OF THE DISCLOSURE

In view of the foregoing disadvantages inherent in the prior art, the general purpose of the present disclosure is to provide a cleaning member for removing particulate from a charge roller of a media processing device, to include all the advantages of the prior art, and to overcome the drawbacks inherent therein.

In one aspect, the present disclosure provides a cleaning member for removing particulate from a charge roller of a media processing device. The cleaning member includes a substrate with a cleaning pad disposed onto the substrate. The cleaning pad is segmented into a plurality of sections capable of contacting the charge roller for removing the particulate from the charge roller.

In another aspect, the present disclosure provides media processing device or a removable cartridge for media processing device that includes a photoconductor drum capable of forming electrostatic latent images thereon. Further, the cartridge includes a charge roller removably coupled to the photoconductor drum. The charge roller charges the photoconductor drum. Furthermore, the cartridge includes a cleaning member configured adjacent to the charge roller for removing particulate from the charge roller. The cleaning member includes a substrate, and a cleaning pad disposed onto the substrate. The cleaning pad is segmented into a plurality of sections capable of contacting the charge roller for removing the particulate from the charge roller.

BRIEF DESCRIPTION OF THE DRAWINGS

The above-mentioned and other features and advantages of this disclosure, and the manner of attaining them, will become more apparent and the disclosure will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of connections set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. Unless limited otherwise, the terms "attached" and "coupled" and variations thereof herein are used broadly and encompass direct and indirect attachments and couplings of two components. In addition, the terms "attached" and "coupled" and variations thereof are not restricted to physical or mechanical attachments and couplings of the two components.

As used herein, the term "abuttingly coupled" refers to a coupling between two components placed adjacent to each other such that each component is capable of transmitting its motion to the other component.

In one aspect, the present disclosure provides a media processing device or a cartridge for such device that employs a cleaning member for cleaning a charge roller of the media processing device. The media processing device of the present disclosure is an electrophotographic image forming device. Suitable examples of the electrophotographic image forming device may include, a laser printer, a copying machine, a multifunctional peripheral and the like.

The electrophotographic image forming device or cartridge therefor of the present disclosure includes a photoconductor drum for forming electrostatic latent images thereon. Further, the electrophotographic image forming device includes a charge roller removably coupled to the photoconductor drum. The charge roller charges the photoconductor drum. Furthermore, the electrophotographic image forming device or cartridge therefor includes a cleaning member configured adjacent to the charge roller for cleaning the charge roller. The electrophotographic image forming device employing the cleaning member is explained in detail in conjunction with FIG. 1.

Figure 1:
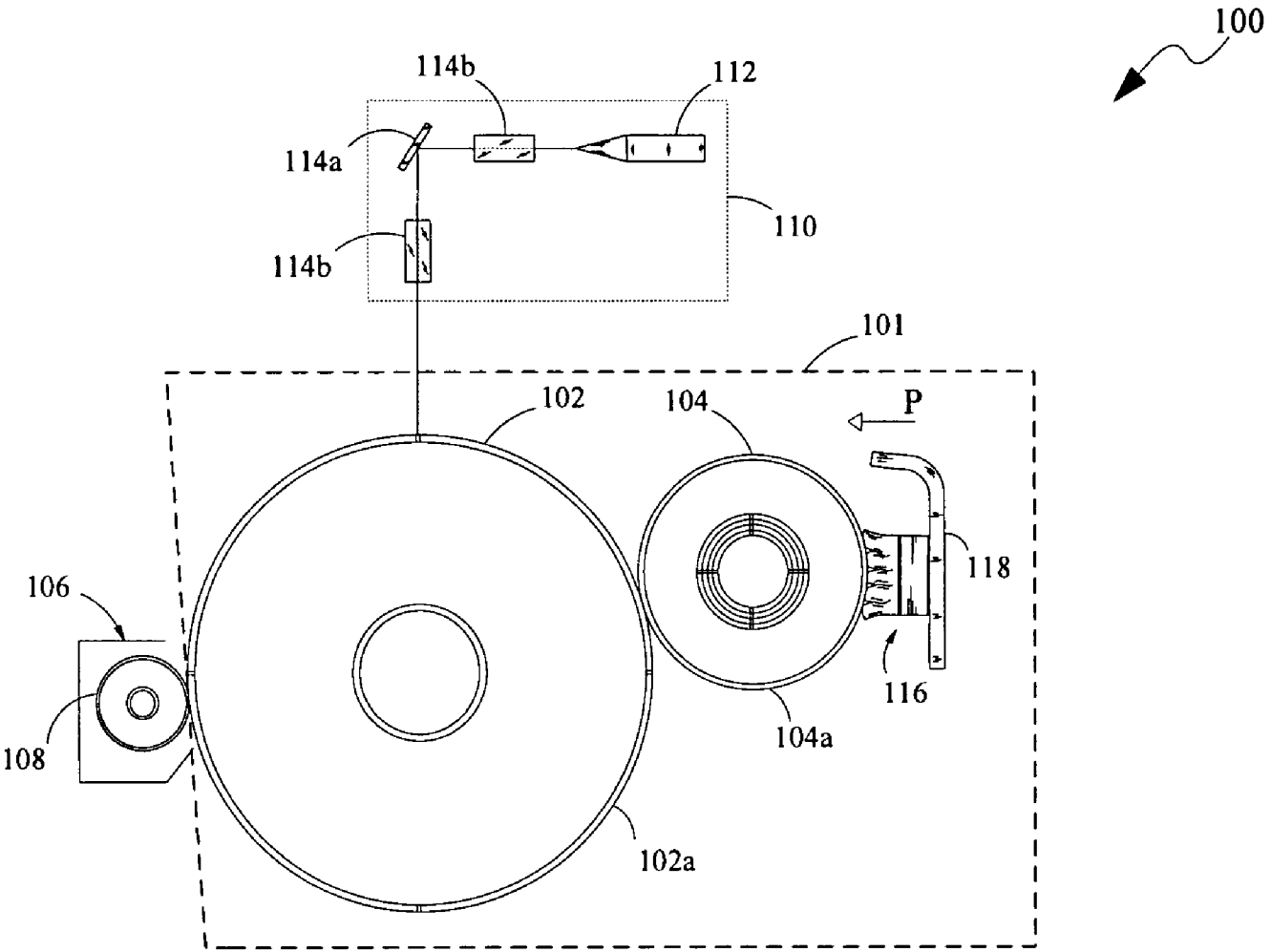
FIG. 1 is a schematic representation of an electrophotographic image forming device employing an embodiment of a cleaning member.

FIG. 1 is a schematic representation of an electrophotographic image forming device 100, according to an embodiment of the present disclosure. Electrophotographic image forming device 100 includes a photoconductor drum 102 (hereinafter referred to as a "PC drum 102"). It will be apparent to a person skilled in the art that PC drum 102 is typically employed in electrophotographic image forming device 100 for developing electrostatic latent images thereon.

PC drum 102 includes a drum substrate (not shown). Further, PC drum 102 includes a coating (not shown) disposed onto the drum substrate. The coating includes a charge generation layer composed of materials capable of photo-generating a charge onto PC drum 102 when contacted by a stream of photons, a charge transport layer composed of materials capable of transporting the generated charge, and optionally, a wear resistance layer capable of providing insulation to the charge generation layer and the charge transport layer.

Further, electrophotographic image forming device 100 includes a charge roller 104 removably coupled to PC drum 102. Charge roller 104 charges PC drum 102 to a predetermined voltage. More specifically, the predetermined voltage charges surface 102*a* of PC drum 102. It should be understood that in a working position (as shown in FIG. 1), charge roller 104 contacts PC drum 102 to charge PC drum 102 to a predetermined voltage. Subsequently, charge roller 104 may be retracted from PC drum 102 into a storage position when the printer is powered down or operates in a power saving mode. Further, charge roller 104 may be mechanically disassembled from PC drum 102 when electrophotographic image forming device 100 is packaged for shipping or storing for long periods. Such a configuration where charge roller 104 is not in contact with PC drum 102 may be referred to as a storage configuration.

In addition to PC drum 102 and charge roller 104, electrophotographic image forming device 100 includes a developer unit 106. Developer unit 106 includes a developer roller 108 abuttingly coupled to PC drum 102. Further, developer unit 106 includes a toner medium (not shown) including toner particles, a metering device such as a doctor blade, a toner adder roller for supplying toner medium to the developer roller 108 and agitators (all not shown). The toner medium is stored in a sump provided in developer unit 106. Developer roller 108 of developer unit 106 is electrically charged and electrostatically attracts the toner particles of the toner medium which are then formed into an even layer on the surface of the developer roller 108 by the metering device. The toner particles of the toner medium are electrostatically attracted onto surface 102*a* of PC drum 102. Further, developer roller 108 is capable of undergoing an angular rotation in a direction opposite to a direction of the angular rotation of PC drum 102 for transferring the toner particles onto surface 102*a* of PC drum 102.

PC drum 102, charge roller 104, cleaning member 116, support bracket 118 may be contained within a cartridge (indicated by the dashed box 101) that is removably inserted into electrophotographic image forming device 100. Developer unit 106 may also be included in the cartridge 101 in alternate embodiments.

During a typical image forming process and as mentioned above, charge roller 104 charges PC drum 102 to the predetermined voltage. Thereafter, a stream of photons contacts PC drum 102 to photo-generate a discharged area on surface 102*a* of PC drum 102. The stream of photons may be provided by an optical assembly, such as an optical assembly 110 that is operatively coupled to PC drum 102, as shown in FIG. 1.

Optical assembly 110 includes a laser unit 112, one or more mirrors 114*a*, and a one or more lenses 114*b*. However, for the purpose of this description, only one mirror 114*a* is depicted in FIG. 1. Further, one or more mirrors 114*a*, and one or more lenses 114*b* may hereinafter be collectively referred to as "a set of mirrors and lenses 114". It will be apparent to a person skilled in the art that during the typical image forming process, laser unit 112 is capable of providing the stream of photons (in form of a laser beam) required for the photo-generation discharge of PC drum 102. Further, it will be apparent that set of mirrors and lenses 114 directed a modulated the stream of photons provided by laser unit 112. Such a modulation is required to obtain a particular image pattern on surface 102*a* that will become the toned image that is later transferred to medium on which it is fixed.

The photo-generation of the discharged area on surface 102*a* of PC drum 102 generates an electrostatic latent image. After the generation of the electrostatic latent image, developer unit 106 provides the toner medium to surface 102*a* of PC drum 102. Subsequently, the toner particles of the toner medium affix to the electrostatic latent image (due to electrostatic interactions) thereby generating a toned electrostatic latent image. The toned electrostatic latent image is then transferred and fixed onto the media sheet to generate a printed image thereon.

Electrophotographic image forming device 100 or cartridge 101 further includes a cleaning member 116 configured adjacent to charge roller 104. Further, as shown in FIG. 1, cleaning member 116 is attached to a support bracket 118 that enables cleaning member 116 to peripherally contact the surface of charge roller 104. More specifically, cleaning member 116 is adhered to support bracket 118 using an adhesive. The composition of the adhesive will be described later in the description.

For the purpose of this description, support bracket 118 is shown to be L-shaped, as shown in FIG. 1. However, support bracket 118 may be designed to have any other shape, such as a U-Shape or a C-shape. Further, it should be understood that support bracket 118, as used herein, may be any surface, typically located proximate to charge roller 104, in electrophotographic image forming device 100 or cartridge 101. It should also be understood that support bracket 118 may be a metal bracket that carries a cleaning blade (not shown) configured to PC drum 102 for cleaning PC drum 102.

Cleaning member 116 is capable of removing particulate from charge roller 104. The term "particulate," as used herein, refers to unwanted debris including toner particles, paper dust, and other similar matter that adheres to and deposits over a peripheral surface 104*a* of charge roller 104 after one or more image forming processes. For removing such particulate, cleaning member 116 applies a cleaning pressure P (as shown in FIG. 1), which ranges from about 0.01 to about 20.0 pounds per square inch (psi), on charge roller 104 for cleaning charge roller 104. More specifically, cleaning member 116 applies cleaning pressure P on peripheral surface 104*a* of charge roller 104. Cleaning member 116 contacts peripheral surface 104*a* of charge roller 104 to apply cleaning pressure P on peripheral surface 104*a* of charge roller 104. Subsequently, cleaning member 116 removes the particulate deposited on peripheral surface 104*a* of charge roller 104 after the image forming process. Cleaning member 116 is further explained in detail in conjunction with FIG. 2.

Figure 2:
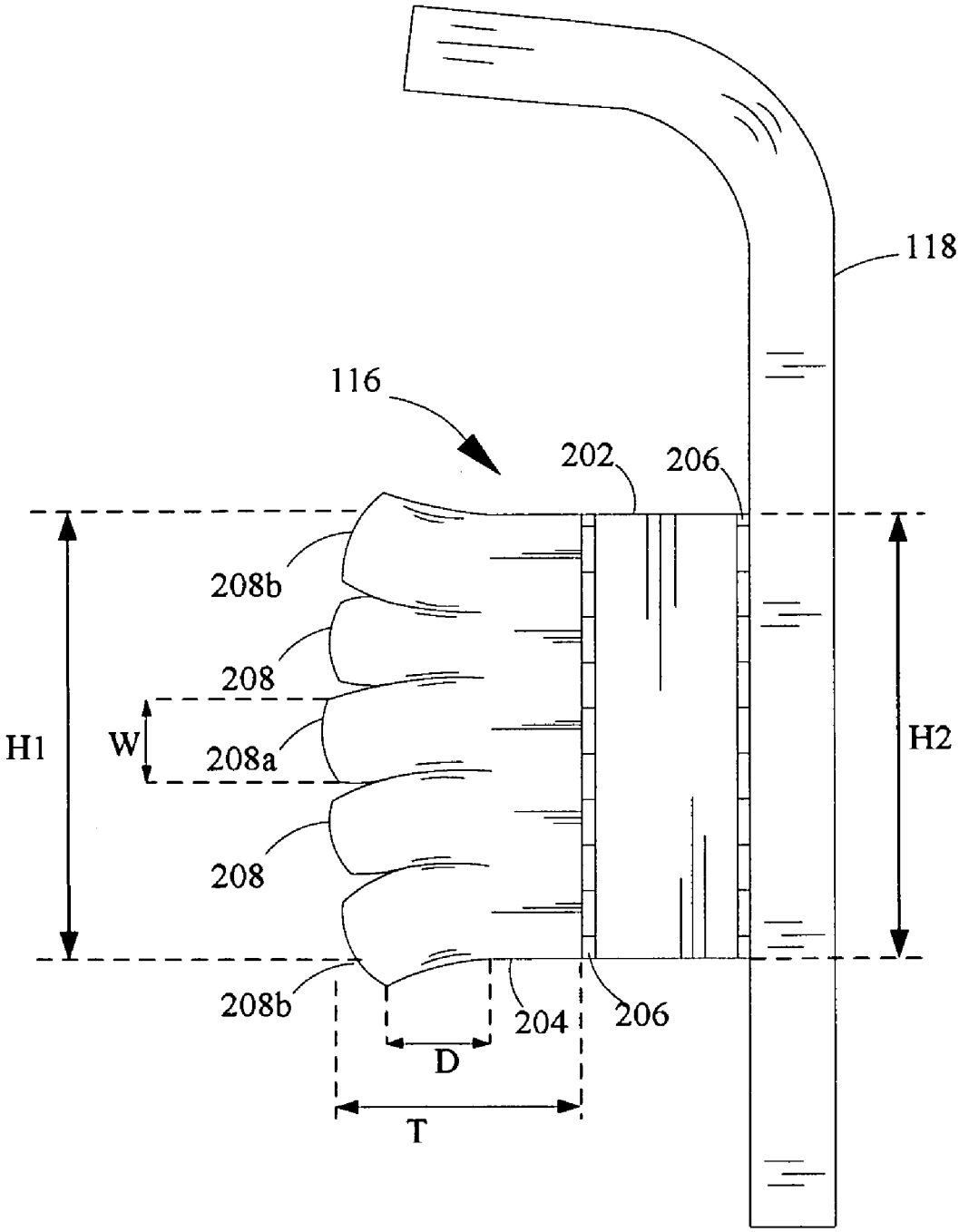
FIG. 2 is a side view of the cleaning member of FIG. 1.

FIG. 2 depicts a side view of cleaning member 116 attached to support bracket 118, according to an embodiment of the present disclosure. As shown in FIG. 2, cleaning member 116 includes a substrate 202. It will be apparent to a person skilled in the art that substrate 202 may be of any appropriate shape and a size. For the purpose of this description, substrate 202 is an elongated substrate. Further, substrate 202 has a thickness ranging from about 0.001 to about 0.010 inches.

Substrate 202 includes a material selected from the group consisting of a polymeric material, a metallic material, a composite material, a ceramic material, or a combination thereof. However, for the purpose of this description, substrate 202 includes a polymeric material. Such a polymeric material may be either a thermoplastic polymeric material, a thermo-set polymeric material, or an elastomer polymeric material. Accordingly, suitable examples of the polymeric material may include, but are not limited to, polyester such as polyethylene terephthalate (PET), polycarbonate, polyetherimide, polyurethane, natural rubber, synthetic rubber, styrene-butadiene copolymer, and combinations thereof. However, it should be clearly understood that the above-stated examples of the polymeric material are only for exemplary purposes and should not be construed as a limitation to the present disclosure. Further, it should be understood that the polymeric material may be used in form of a film (extruded or cast) or in a molded form. Furthermore, substrate 202 may be used in form of a polymeric strip. For the purpose of this description, the polymeric material is a material that is commercially available under the trade name Mylar® available from Dupont Teijin Films.

Cleaning member 116 includes a cleaning pad 204 disposed onto substrate 202. More specifically, cleaning pad 204 is disposed onto a first surface (not shown) of substrate 202 that faces peripheral surface 104*a* of charge roller 104, as shown in FIG. 1.

Cleaning pad 204 is affixed onto the first surface of substrate 202, which faces peripheral surface 104*a* of charge roller 104, using at least one of an adhesive or a primer. The adhesive may be a hot melt adhesive or a pressure sensitive adhesive. Moreover, the adhesive either may be an acrylic copolymer, an epoxy polymer, or a rubber-based polymer such as a styrene block copolymer. Suitable examples of the adhesive include, but are not limited to, 9500 double coated acrylic tape product, EAD 461 double coated acrylic tape product, and EAD 438 double coated acrylic tape product (available from 3M Corporation, St. Paul. Minn.). In an embodiment of the present disclosure, the adhesive is EAD 461 double coated acrylic tape product. Moreover, a suitable example of the primer employed in the present disclosure includes Chemlok 250 (available from The Lord Corporation).

The adhesive may be applied as an adhesive layer, such as an adhesive layer 206, as shown in FIG. 2. Adhesive layer 206 either may be applied directly onto the first surface of substrate 202 or may be applied onto a surface (not shown) of cleaning pad 204, which may then be affixed to the first surface of substrate 202. Furthermore, application of adhesive layer 206 may be in form of a continuous layer (as shown in FIG. 2) or in form of a non-continuous layer (i.e. applied as distinct spots). The cleaning pad 204 may also be affixed to the first surface of substrate 202 by techniques such as heat staking, ultrasonic welding, and mechanical attachment. Cleaning pad 204 has a height H1 that can be less than, equal to or greater than the height H2 of substrate 202.

The adhesive may be also be used for attaching cleaning member 116 to support 118. More specifically, the adhesive may be applied (in form of a layer, such as adhesive layer 206) onto a second surface of substrate 202, which may then be affixed to support bracket 118. The second surface of substrate 202 is different from the first surface, which faces peripheral surface 104*a* of charge roller 104.

Cleaning pad 204 of cleaning member 116 may be designed with various cross-sectional shapes such as a trapezoidal shape, a rectangular shape and a concave shape, a convex shape, or combinations of these. However, for the purpose of this description, cleaning pad 204 is a rectangular in cross-section. Further, cleaning pad 204 is designed to have a size sufficient enough to maximize cleaning efficiency of cleaning member 116 without increasing frictional drag thereof. The term "frictional drag" refers to a force resisting relative motion of cleaning member 116 and charge roller 104 when being in contact with each other. Further, cleaning pad 204 has a dimension in accordance with the circumference and length of charge roller 104. Accordingly, cleaning pad 204 of the present disclosure may have an overall height H1 ranging from about 4.0 to about 8.0 millimeters (more specifically, equal to about 7.5 millimeters), an overall thickness T ranging from about 0.1 to about 8.0 millimeters (more specifically, equal to about 5.0 to 5.5 mm), and a length ranging from about 200 to about 500 millimeters.

Cleaning pad 204 of cleaning member 116 when the charge roller is in its storage position contacts peripheral surface 104*a* of charge roller 104 for absorbing and retaining the particulate therefrom. The direction of rotation of charge roller 104 during a cleaning cycle can vary, one time it is clockwise the next counter clockwise. Other cleaning sequences can also be used. Cleaning pad 204 retains the particulate for long durations of time to prevent the particulate from reattaching to charge roller 104. Further, cleaning pad 204 should be flexible. More specifically, cleaning pad 204 may be capable of providing an elastic response when cleaning member 116 applies cleaning pressure P on peripheral surface 104*a* of charge roller 104.

Moreover, cleaning pad 204 should have a sufficient wear resistance in order to withstand amount of usage of electrophotographic image forming device 100, which typically may be about 20,000 printed media sheets. Also, cleaning pad 204 should have a sufficient thermal and moisture resistance in order to withstand temperatures associated with operation of electrophotographic image forming device 100, and the temperatures and humidity ranges associated with warehouses and ocean shipping containers where electrophotographic image forming device 100 or cartridge 101 may be stored. More specifically, cleaning pad 204 should have a sufficient thermal resistance in order to withstand temperatures (ranging from about 40 degrees Celsius to about 70 degrees Celsius) that are generated near charge roller 104 during operation and the temperatures (ranging from about 20 degrees Celsius to about 50 degrees Celsius) and humidity (ranging from about 5 percent to about 95 percent relative humidity) present within a shipping container during ocean transit and a warehouse during seasonal highs and lows. Based on the foregoing, cleaning pad 204 should have a porous structure, a large resistance to wear and tear, high flexibility, and a high thermal and moisture resistance.

Accordingly, cleaning pad 204 includes a material such as foam, and more specifically, open-celled foam. Usually, open-celled foam includes a plurality of open cells (hereinafter referred to as "open cells") that may permit passage of air therethrough. Further, such open cells are capable of absorbing particulate, such as the particulate deposited on peripheral surface 104*a* of charge roller 104. Furthermore, open cells are capable of effectively retaining the particulate there within to prevent the particulate from reattaching to charge roller 104. Moreover, the open-celled foam has a sufficient wear resistance in order to withstand the amount of usage of electrophotographic image forming device 100 or cartridge 101. In addition, the open-celled foam has a sufficient thermal resistance in order to withstand the temperatures that are generated near charge roller 104 of electrophotographic image forming device 100.

The open-celled foam as used in cleaning pad 204 may include a polymeric material such as polyurethane, polyolefin, silicone, and combinations thereof. More specifically, the open-celled foam as used herein may be polyether-urethane foam available from Foamex International Inc., of Linwood, Pa., U.S.A. It should be understood that the aforementioned examples of the polymeric material of the open-celled foam in cleaning pad 204 is only for exemplary purposes and should not be construed as a limitation to the present disclosure.

Additionally, the open-celled foam as used in cleaning pad 204 may have a pore size ranging from about 50 to about 150 pores per linear inch, and a density ranging from about 0.5 to about 14 pounds per cubic foot. Moreover, the open-celled foam may have a tensile strength ranging from about 15 to about 40 pounds per square foot.

As depicted in FIG. 2, cleaning pad 204 is segmented into a plurality of sections or fingers 208 (hereinafter referred to as "sections 208"). The segmentation of cleaning pad 204 may be performed by providing a plurality of lengthwise or longitudinal cuts (into the plane of the drawing sheet of FIG. 2) on the a surface of cleaning pad 204, which is adjacent charge roller 104. Such longitudinal cuts may be provided by employing precision foam cutting machines such as hot-wire cutters or sharpened steel blades. Moreover, it should be understood that the longitudinal cuts either may be provided during the manufacturing of cleaning pad 204 or may be provided after cleaning pad 204 is disposed onto the substrate.

Figure 4:
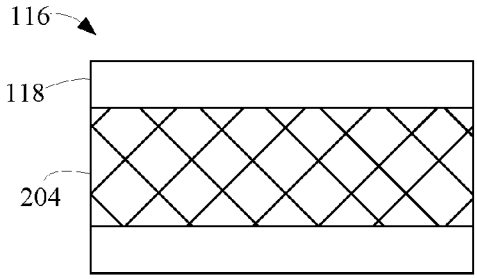
FIG. 4 is a front elevation view of the cleaning member showing a pattern of X-shaped cuts in the face of the cleaning pad.
Figure 5:
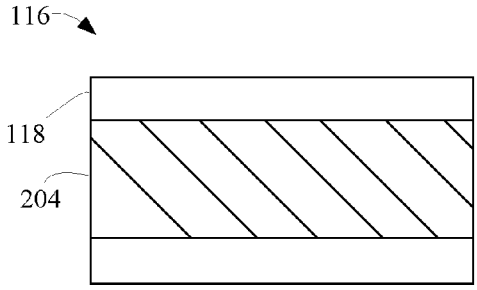
FIG. 5 is a front elevation view of the cleaning member showing a pattern of diagonal cuts in the face of the cleaning pad.
Figure 6:
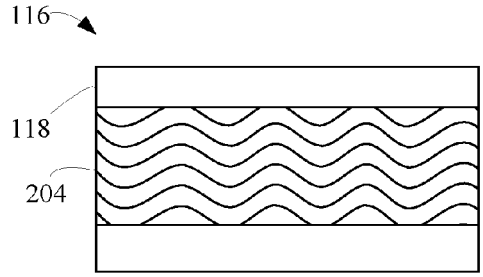
FIG. 6 is a front elevation view of the cleaning member showing a pattern of wavy cuts in the face of the cleaning pad.
Figure 7:
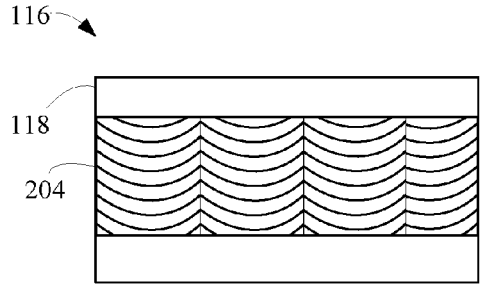
FIG. 7 is a front elevation view of the cleaning member showing a pattern of C-shaped cuts in the face of the cleaning pad.
Figure 8:
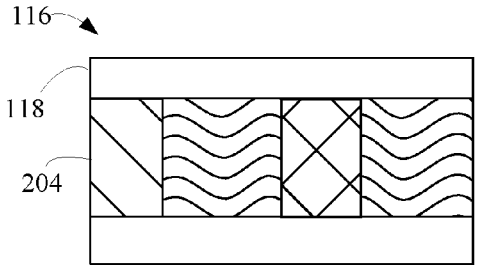
FIG. 8 is a front elevation view of the cleaning member showing a combination of X-shaped cuts, diagonal cuts and wavy cuts in the face of the cleaning pad.
Figure 9:
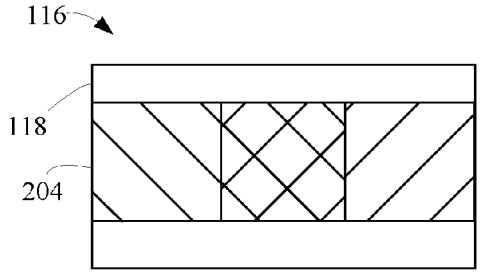
FIG. 9 is a front elevation view of the cleaning member showing a combination of diagonal cuts and X-shaped cuts in the face of the cleaning pad.
Figure 10:
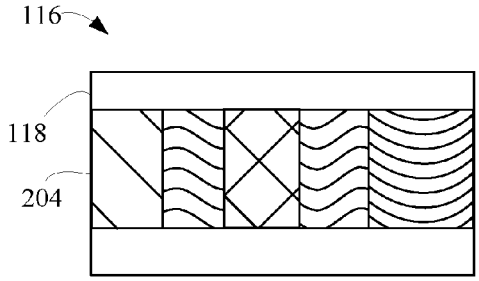
FIG. 10 is a front elevation view of the cleaning member showing a combination of diagonal cuts, wavy cuts, X-shaped cuts, and C-shaped cuts in the face of the cleaning pad.

Further, as it is evident from FIG. 2, the longitudinal cuts partially segment cleaning pad 204 to form sections 208. More specifically, these longitudinal cuts are provided onto the surface of cleaning pad 204 to form sections 208 ranging from about 0.5 to about 5 millimeters in width (as shown by symbol "W" in FIG. 2) and from about 1.7 to about 2.2 millimeters in depth (as shown by symbol "D" in FIG. 2), i.e., the widths of sections 208 can vary from one another. As shown in FIG. 2, the depth D of the cuts is less than the thickness T of cleaning pad 204 so that the cleaning pad 204 remains a single pad having multiple segments in its cleaning surface. Even more specifically, the longitudinal cuts are provided onto the surface of cleaning pad 204 to form approximately equal sections 208 (five sections are illustrated). Alternatively, the longitudinal cuts may be provided onto the surface of cleaning pad 204 to form four approximately equal sections 208. Further, the longitudinal cuts are provided in such a way that sections 208 are capable of contacting charge roller 104 for removing the particulate therefrom by absorbing and retaining. While longitudinal cuts are illustrated, it is expected that other longitudinal cut patterns across the face surface of the cleaning pad 204 may also be used such as diagonal cuts, X-shaped or crossing diagonal cuts, wavy cuts, C-shaped cuts, combinations of these, etc. It is believed that vertical cuts (along height H1) would not be as effective because gaps between the sections could occur allowing portions of the surface of charge roller 104 not to completely cleaned as it is rotated. FIG. 4 illustrates a pattern of X-shaped cuts in the face of the cleaning pad 204. FIG. 5 illustrates a pattern of diagonal cuts in the face of the cleaning pad 204. FIG. 6 illustrates a pattern of wavy cuts in the face of the cleaning pad 204. FIG. 7 illustrates a pattern of C-shaped cuts in the face of the cleaning pad 204. FIG. 8 shows a combination of X-shaped cuts, diagonal cuts, and wavy cuts in the face of the cleaning pad 204. FIG. 9 depicts a combination of diagonal cuts and X-shaped cuts in the face of the cleaning pad 204. FIG. 10 shows a combination of diagonal cuts, wavy cuts, X-shaped cuts, and C-shaped cuts in the face of the cleaning pad 204.

Figure 3:
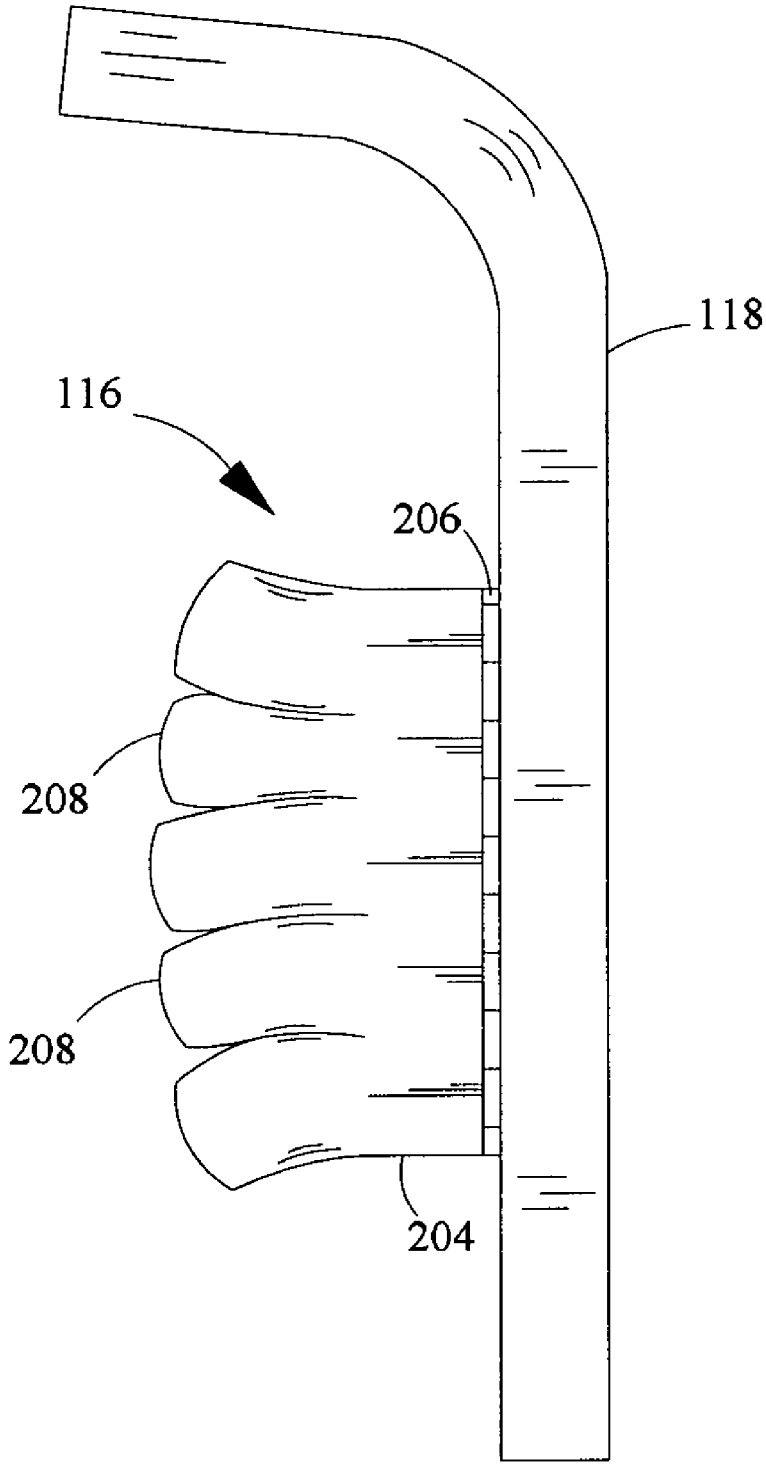
FIG. 3 is a side view of another embodiment of the cleaning.

As depicted in FIGS. 2 and 3, each of sections 208 of cleaning pad 204 is capable of moving independently of the other. Cleaning efficiency of cleaning member 116 is directly related to contact area provided by cleaning pad 204, and more specifically, by sections 208, of cleaning member 116. Sections 208 effectively increase the surface area of the foam in cleaning pad 204 that can contact charge roller 104. Sections 208 permit the charge roller 104 to contact more surface area of the cleaning pad including exposing interior portions of the pad due to the longitudinal cuts. Because charge roller can be cleaned using different directions of rotation, sections 208 allow even greater amount surface area to be used for cleaning. The more the contact area provided by cleaning pad 204, the better the cleaning efficiency of cleaning member 116. Further by exposing more of the interior of cleaning pad 204 to the charge roller, a greater volume of foam cells are available for retaining the particles that are removed from the surface of charge roller 104 when it is cleaned. The independent movement of each of sections 208 of cleaning pad 204 helps providing more cleaning area for an efficient cleaning. In addition, each of sections 208, including central section 208*a* and distal sections 208*b*, are effectively involved in the cleaning process for an optimum utilization thereof to increase the cleaning efficiency of cleaning pad 204.

The contact between cleaning pad 204 and charge roller 104 may result in generation of a pressure gradient therebetween due to the shape of cleaning pad 204. However, the effective involvement of each of sections 208, including central section 208*a* and distal sections 208*b*, in the cleaning process helps reduce the pressure gradient generated between cleaning pad 204 and charge roller 104, and more specifically, from central section 208*a* to distal sections 208*b*.

Further, it should be understood that compression set defects in the open-celled foam employed in cleaning pad 204 may occur if cleaning pressure between cleaning pad 204 and charge roller 104 is of a high magnitude. However, sections 208 are capable of generating pressures of low magnitude due to their independent movement in order to reduce any likelihood of compression set defects in the open-celled foam.

In addition to the above, it should also be understood that the generation of pressures of low magnitude between cleaning pad 204 and charge roller 104, due to the segmentation of cleaning pad 204, allows for employing thicker cleaning pad 204 in cleaning member 116 without causing any stalling of charge roller 104. Typical cleaning pad thickness are about 4 mm±0.3 mm whereas with one preferred embodiment, the cleaning pad 204 has a thickness of about 5.0-5.5 mm±0.3 mm or about 25% to about 37.5% thicker. Use of thicker cleaning pad 204 increases the ease of manufacturability of cleaning pad 204 because the tolerance range for the thicker pad represents a smaller percentage of the thickness dimension (5.4 to 6% versus 7.5% for the thinner pad). Moreover, it should be understood that effective lifetime of cleaning pad 204 is dependent on available volume of the open-celled foam for trapping and retaining the particulate within. Accordingly, the segmentation of cleaning pad 204, and more specifically, the open-celled foam, provides a large capacity for retaining the particulate within and helps in increasing usable/functional lifetime of cleaning pad 204. This helps in keeping charge roller 104 free of the particulate, and further reduces any likelihood of deterioration of charging ability of charge roller 104. Accordingly, use of cleaning member 116 helps in increasing effective lifetime of electrophotographic image forming device 100.

Now referring to FIG. 3, there is shown a cleaning member 116 according to another embodiment. As shown in FIG. 3, cleaning member 116 includes a cleaning pad 204 which is similar in shape, size, design, and material of construction to cleaning pad 204 described in conjunction with FIG. 2. Further, cleaning pad 204 is shown to be affixed to support bracket 118 using an adhesive applied in the form of adhesive layer 206. It should be understood that the adhesive is similar in composition to the adhesive described in conjunction with FIG. 2. Moreover, it will be apparent that such a cleaning member 116 will be employed in an electrophotographic image forming device, such as electrophotographic image forming device 100, described in conjunction with FIG. 1. The arrangement shown in FIG. 3 has less flexibility than that shown in FIG. 2 due to the absence of substrate 202.

In another aspect, the present disclosure provides a cleaning member, such as cleaning member 116 as described above, for removing particulate from a charge roller, such as charge roller 104, of a media processing device, such as electrophotographic image forming device 100. The cleaning member includes a substrate, such as substrate 202. The substrate includes a material selected from the group consisting of a polymeric material, a metallic material, a composite material, and a ceramic material. The polymeric material, as used in the substrate, may be selected from the group consisting of polyester, polycarbonate, polyetherimide, polyurethane, natural rubber, synthetic rubber, styrene-butadiene copolymer, and combinations thereof.

Further, the cleaning member includes a cleaning pad, such as cleaning pad 204, disposed onto the substrate. The cleaning pad is segmented into a plurality of sections, such as sections 208, capable of contacting the charge roller for removing the particulate from the charge roller. Further, the cleaning pad may include open-celled foam that includes a polymeric material. The polymeric material, as used for the open-celled foam, may be selected from the group consisting of polyurethane, polyolefin, silicone, and combinations thereof. Further, the open-celled foam may have a density ranging from about 0.5 to about 14 pounds per cubic foot.

The cleaning member further may comprise at least one of an adhesive and a primer applied between the substrate and the cleaning pad. The at least one of the adhesive and the primer affixes the cleaning pad onto the substrate for disposing the cleaning pad onto the substrate. It should be apparent that the adhesive may be applied in form of an adhesive layer, such as adhesive layer 206.

Based on the foregoing, the present disclosure provides a media processing device, a cartridge and a cleaning member capable of removing particulate from a charge roller of the media processing device. The cleaning member includes a substrate and a cleaning pad disposed onto the substrate. Alternatively, the cleaning comprises a cleaning pad having an adhesive layer allowing the cleaning pad to be attached directly to a support surface or support bracket in a media processing device or a cartridge therefor. The cleaning member provides a large capacity to trap the particulate deposited over the charge roller. Accordingly, the cleaning member allows for keeping the charge roller clean, thereby allowing the charge roller to retain good charging capabilities. This helps in increasing effective lifetime of the media processing device or cartridge. Further, the cleaning member is capable of applying sufficient pressure for effectively cleaning the charge roller without increasing frictional drag in between the cleaning member and the charge roller. The same prevents frequent stalling of the charge roller. Furthermore, the cleaning member has reduced risk of undergoing physical defects, and more specifically, compression set defects, of the cleaning pad. Moreover, the cleaning member is easy to manufacture and configure in the media processing device or cartridge.

The foregoing description of several embodiments and methods of the present disclosure have been presented for purposes of illustration. It is not intended to be exhaustive or to limit the present disclosure to the precise steps and/or forms disclosed, and obviously many modifications and variations are possible in light of the above teaching. It is intended that the scope of the present disclosure be defined by the claims appended hereto.

What is claimed is:

1. A cleaning member for removing particulate from a charge roller of a media processing device, the cleaning member comprising:

a cleaning pad, the cleaning pad segmented into a plurality of sections, the plurality of sections being formed by a plurality of cuts extending generally along the longitudinal face of the cleaning pad, the plurality of cuts each having a depth that is less than a thickness of the cleaning pad, the plurality of sections capable of contacting the charge roller for removing the particulate from the charge roller.

2. The cleaning member of claim 1 further comprising a substrate with the cleaning pad disposed on a surface thereof.

3. The cleaning member of claim 2 further comprising at least one of an adhesive and a primer applied between the substrate and the cleaning pad, wherein the at least one of the adhesive and the primer affixes the cleaning pad onto the substrate for disposing the cleaning pad onto the substrate.

4. The cleaning member of claim 2 wherein the substrate comprises a material selected from the group consisting of a polymeric material, a metallic material, a composite material, and a ceramic material.

5. The cleaning member of claim 4 wherein the polymeric material is selected from the group consisting of polyester, polycarbonate, polyetherimide, polyurethane, natural rubber, synthetic rubber, styrene-butadiene copolymer, and combinations thereof.

6. The cleaning member of claim 1 wherein the cleaning pad comprises open-celled foam.

7. The cleaning member of claim 6 wherein the open-celled foam comprises a polymeric material selected from the group consisting of polyurethane, polyolefin, silicone, and combinations thereof.

8. The cleaning member of claim 6 wherein the open-celled foam has a density ranging from about 0.5 to about 14 pounds per cubic foot.

9. The cleaning member of claim 1 wherein the plurality of cuts is in one of a pattern of approximately parallel cuts, diagonal cuts, X-shaped cuts, wavy cuts, C-shaped cuts, and combinations of the foregoing.

10. A cartridge for an image forming device, comprising:

a photoconductor drum;

a charge roller, removably coupled to the photoconductor drum, for charging the photoconductor drum; and a cleaning member configured adjacent to the charge roller, the cleaning member capable of removing particulate from the charge roller, the cleaning member comprising:

a cleaning pad, the cleaning pad segmented into a plurality of longitudinal sections, the plurality of sections being formed by a plurality of cuts in the cleaning pad, the plurality of cuts each having a depth that is less than a thickness of the cleaning pad, the plurality of sections capable of contacting the charge roller for removing the particulate from the charge roller.

11. The cartridge of claim 10 wherein the cleaning member further comprises a substrate with the cleaning pad disposed on a surface thereof.

12. The cartridge of claim 11 wherein the substrate comprises a material selected from the group consisting of a polymeric material, a metallic material, a composite material, and a ceramic material.

13. The cartridge of claim 12 wherein the polymeric material is selected from the group consisting of polyester, polyurethane, polycarbonate, natural rubber, synthetic rubber, styrene-butadiene copolymer, polyetherimide and combinations thereof.

14. The cartridge of claim 10 further comprising a support bracket, the cleaning member being attached to the support bracket.

15. The cartridge of claim 10 wherein the cleaning pad comprises open-celled foam.

16. The cartridge of claim 15 wherein the open-celled foam comprises a polymeric material selected from the group consisting of polyurethane, polyolefin, silicone, and combinations thereof.

17. The cartridge of claim 15 wherein the open-celled foam has a density ranging from about 0.5 to about 14 pounds per cubic foot.

18. The cartridge of claim 10 wherein the plurality of cuts is in one of a pattern of approximately parallel cuts, diagonal cuts, X-shaped cuts, wavy cuts, C-shaped cuts, and combinations of the foregoing.

19. A media processing device comprising:

a photoconductor drum capable of forming electrostatic latent images thereon;

a charge roller for charging the photoconductor drum removably coupled to the photoconductor drum, the charge roller moveable between a working position and a storage position; and a cleaning member configured adjacent to the charge roller in the storage position, the cleaning member capable of removing particulate from the charge roller, the cleaning member comprising:

an open-celled foam cleaning pad segmented into a plurality of longitudinal sections formed by a plurality of cuts, the plurality of cuts each having a depth that is less than a thickness of the cleaning pad, the plurality of sections capable of contacting the charge roller for removing the particulate from the charge roller.

20. The media processing device of claim 19 wherein the open-celled foam comprises a polymeric material selected from the group consisting of polyurethane, polyolefin, silicone, and combinations thereof.

21. The media processing device of claim 19 wherein the open-celled foam has a density ranging from about 0.5 to about 14 pounds per cubic foot.

22. The media processing device of claim 19 further comprising a support bracket and the cleaning member further comprising a substrate with the cleaning pad being attached to the substrate and the substrate being attached to the support bracket.

* * * * *